US005415711A

United States Patent [19]

Takagi et al.

[11] Patent Number: 5,415,711

[45] Date of Patent: May 16, 1995

[54] HIGH-STRENGTH SPRING STEELS AND METHOD OF PRODUCING THE SAME

[75] Inventors: Masaaki Takagi, Komaki; Shigeru Takeda; Hideaki Inaba, both of Chita, all of Japan

[73] Assignee: Daido Tokushuko Kabushiki Kaisha, Nagoya, Japan

[21] Appl. No.: 309,605

[22] Filed: Sep. 21, 1994

Related U.S. Application Data

[63] Continuation of Ser. No. 868,095, Apr. 14, 1992, abandoned.

[30] Foreign Application Priority Data

Feb. 3, 1992 [JP] Japan ..... 4-017843

[51] Int. Cl.[6] ..... C22C 38/00; C22C 38/02

[52] U.S. Cl. ..... 148/546; 148/547; 148/580; 148/328; 148/335; 148/908; 420/109

[58] Field of Search ..... 148/546, 547, 580, 328, 148/335, 908; 420/109

[56] References Cited

U.S. PATENT DOCUMENTS

| | | | |
|---|---|---|---|
| 4,092,178 | 5/1978 | Onoe et al. | 148/541 |
| 4,795,609 | 1/1989 | Saka et al. | 420/109 |
| 5,009,843 | 4/1991 | Sugimoto et al. | 420/109 |
| 5,286,312 | 2/1994 | Shimotsusa et al. | 420/109 |

FOREIGN PATENT DOCUMENTS

| | | |
|---|---|---|
| 1051201 | 5/1991 | China . |
| 46-40853 | 12/1971 | Japan . |
| 51-002616 | 1/1976 | Japan . |
| 0644846 | 1/1979 | U.S.S.R. . |

*Primary Examiner*—Scott Kastler
*Assistant Examiner*—Sikyin Ip
*Attorney, Agent, or Firm*—Sughrue, Mion, Zinn, Macpeak & Seas

[57] ABSTRACT

A high-strength spring steel has a high fatigue limit and is characterized by restricting the number of oxide particle inclusion having a diameter of not less than 10 μm in steel to not more than 12 particles/100 mm$^2$.

4 Claims, No Drawings

HIGH-STRENGTH SPRING STEELS AND METHOD OF PRODUCING THE SAME

This is a Continuation of application Ser. No. 07/868,095, filed Apr. 14, 1992, now abandoned.

BACKGROUND OF THE INVENTION 1. Field of the Invention

This invention relates to high-strength spring steels which can be used as a material for high-strength springs in form of hot formed coil spring or cold formed coil spring for use in automobiles, airplane equipments, various industrial machines, various agricultural machines and the like as well as a method of producing the same.

2. Description of the Related Art

Heretofore, the manufacture of coil springs is roughly classified into hot forming and cold forming.

In case of the hot forming, the steel material is hot coiled, subjected to a heat treatment such as quench hardening and tempering, and thereafter subjected to shot peening and setting.

In case of the cold forming, the steel material is subjected to an oil tempering, cold coiled and thereafter subjected to shot peening and setting.

On the other hand, there are made various attempts for increasing the strength of the spring and more improving fatigue limit thereof. Among them, it is attempted to adjust the chemical composition of steel for more increasing the strength of the spring and improving the fatigue limit.

In the conventional springs made from the starting material for the production of high-strength spring steel, however, the increase of the strength and the improvement of the fatigue limit are critical only by the adjustment of the chemical composition, so that there is a problem that it is difficult to stably obtain high-strength springs. Therefore, it is demanded to solve the above problems.

SUMMARY OF THE INVENTION

It is, therefore, an object of the invention to solve the problems of the conventional technique and to provide high-strength spring steels capable of favorably using as a starting material for hot formed coil spring or cold formed coil spring and having a high fatigue limit and fatigue strength as well as a method of producing the same.

According to a first aspect of the invention, there is the provision of a high-strength spring steel characterized by restricting the number of oxide particle inclusion having a diameter of not less than 10 μm in steel to not more than 12 particles/100mm$^2$. In a preferred embodiment, the steel has a composition of C: 0.3–0.5% by weight (hereinafter shown by % simply), Si: 1.0–3.0%, Mn: 0.5–1.5%, P: not more than 0.02%, S: not more than 0.03%, Ni: 0.1–2.0%, Cr: 0.5–1.0%, Mo: 0.1–0.5%, V: 0.1–0.5% and the balance being Fe and inevitable impurity. In another preferred embodiment, S content is 0.01–0.02%. In the other preferred embodiment, the steel contains 0.01–0.03% of Al or not more than 0.002% of O.

According to a second aspect of the invention, there is the provision of a method of producing high-strength spring steels, which comprises blooming an ingot or a cast slab of steel having a composition of C: 0.3–0.5%, Si: 1.0–3.0%, Mn: 0.5–1.5%, P: not more than 0.02%, S: not more than 0.03%, Ni: 0.1–2.0%, Cr: 0.5–1.0%, Mo: 0.1–0.5%, V: 0.1–0.5%, Al: 0.01–0.03% as a selective element and the balance being Fe and inevitable impurity obtained by an ingot making process or a continuously casting process at a blooming temperature of not lower than 1200° C. and then cooling the thus obtained billet after the blooming at an average cooling rate of not more than 1.5° C./sec. In a preferred embodiment, the billet after the blooming is cooled at an average cooling rate of not more than 0.3° C./sec.

DESCRIPTION OF THE PREFERRED EMBODIMENTS

In the high-strength spring steel according to the invention, the reason why the number of oxide particle inclusion having a diameter of not less than 10 μm in steel is restricted to not more than 12 particles/100 mm$^2$ is due to the fact that when the oxide particle inclusion having a diameter of not less than 10 μm becomes too large amount, the fatigue limit lowers and the fatigue life of the spring is short.

That is, in order to increase the fatigue limit, it is necessary to restrict the number of the oxide particle inclusion having a diameter of not less than 10 μm to not more than 12 particles/100 mm$^2$. For this purpose, molten steel is forcedly stirred while introducing a non-oxidizing gas thereinto to sufficiently float and separate large particles of non-metallic inclusion included in molten steel, or molten steel is subjected to vaccum degassing treatment under a low vacuum degree for a long time or under a high vacuum degree for a short time, whereby the oxide particle inclusion having a diameter of not less than 10 μm in steel is restricted to not more than 12 particles/100 mm$^2$.

The high-strength spring steel according to the invention is applicable to spring steels having a chemical composition (% by weight) as mentioned below.

C: 0.3–0.5%

C is an element effective for enhancing the strength of steel. When the amount is less than 0.3%, the required strength can not be obtained, while when it exceeds 0.5%, network-like cementite is apt to precipitate and the fatigue strength is lost, so that the amount of C is desirable to be within a range of 0.3–0.5%.

Si: 1.0–3.0%

Si is an element effective for improving the strength of steel and the sag resistance of the spring as a solid solution in ferrite. When the amount is less than 1.0%, the sag resistance required as a spring can not be obtained, while when it exceeds 3.0%, the toughness is degraded and there is caused a fear of producing free carbon by heat treatment, so that the amount of Si is desirable to be within a range of 1.0–3.0%.

Mn: 0.5–1.5%

Mn is effective for deoxidation and desulfurization of steel and is an element effective for improving the quench hardenability of steel. For this purpose, it is desirable to contain not less than 0.5%. However, when the amount exceeds 1.5%, the quench hardenability becomes too excessive to degrade the toughness and also the deformation is caused in the quench hardening, so that the amount of Mn is desirable to be within a range of 0.5–1.5%.

P: not more than 0.02%

When the amount of P is too large, it tends to cause the brittlement of the base matrix and the ductility lowers, so that it is desirable to be not more than 0.02%.

S: not more than 0.03%

When the amount of S is too large, it tends to lower the hot workability, so that it is desirable to be not more than 0.03%. And also, S has an action improving the cutting property, so that the amount of S is laborable to be within a range of 0.01–0.02% for improving the cutting property to obtain a good surface-sclaping property.

Ni: 0.1–2.0%

Ni is an element effective for improving the toughness after the quench hardening and tempering. Therefore, it is desirable to be not less than 0.1% from a viewpoint of the improvement of the toughness. However, as the Ni amount increases, the amount of residual austenite after the quench hardening and tempering increases, which badly affects the fatigue limit of the spring. Therefore, in order to obtain a high-strength spring having excellent fatigue strength, it is necessary to reduce the amount of residual austenite after the quench hardening and tempering, from which the amount is desirable to be not more than 2.0%. That is, the Ni amount is within a range of 0.1–2.0%.

Cr: 0.5–1.0%

Cr is an element effective for preventing decarburization and graphitization of high carbon steel. When the amount is less than 0.5%, the above effect can not sufficiently be obtained, while when it exceeds 1.0%, the toughness tends to lower, so that the amount is desirable to be within a range of 0.5–1.0%.

V: 0.1–0.5%

V is large in the effect of fining crystal grains in the low temperature rolling and can attain the improvement of the spring properties and the increase of the reliability and contributes to precipitation hardening in the quenching and tempering and also improves the sag resistance of the spring. In order to obtain such effects, it is desirable to be not less than 0.1%. While, when it exceeds 0.5%, the toughness is degraded and also it tends to lower the spring properties. Therefore, the amount of V is within a range of 0.1–0.5%.

Mo: 0.1–0.5%

When the amount of Mo is less than 0.1%, the effect of improving the sag resistance is not sufficiently obtained, while when it exceeds 0.5%, the above effect is saturated and a composite compound not dessolving in the austenite may be formed, and if the amount of the composite compound is increased to form a large lump, the same influence as in the non-metallic inclusion is caused to fear the lowering of the fatigue limit of the steel. Therefore, Mo is desirable to be within a range of 0.1–0.5%.

Al: 0.01–0.03%

Al is a deoxidizing element. When the amount is less than 0.01%, the effect can not be expected, while when it becomes too large amount, the occurrence of macro-streak-flaw on the base matrix is caused, so that it is desirable to be not more than 0.03%.

O: not more than 0.002%

O produces the inclusion of oxide particle resulting in the point of fatigue fracture, so that it is desirable to be not more than 0.002%.

In the production of the high strength spring steel according to the invention, a steel having the above chemical composition for spring steel is melted, from which an ingot is manufactured by an ingot making process using an ingot mold, or a cast slab is manufactured by a continuous casting process using a continuous casting mold, and then the resulting ingot or cast slab is bloomed.

In the blooming, it is preferable to conduct the blooming at a temperature of not lower than 1200° C. without producing work breakage. However, when the temperature is too high, the productivity is lowered, so that it is desirable to be not higher than 1350° C.

After the blooming, the resulting billet is cooled. In this connection, a relation between the cooling rate of the billet and the occurrence of cracks was examined with respect to each of the billets having a chemical composition as shown in Examples 1–13 of Table 2. As shown in Table 1, when the cooling rate of the billet exceeds 1.5° C./sec, cracks may occur in the cooling of the billet and the handling with a grinder, while when the cooling rate of the billet is more than 0.3° C./sec but not more than 1.5° C./sec, cracks occur in the handling with the grinder but cracks do not occur in the cooling of the billet. When the cooling rate of the billet is not more than 0.3° C./sec, there is no crack in the cooling of the billet and the handling with the grinder.

TABLE 1

| Cooling rate of billet | Occurrence of cracks in the cooling of billet | Occurrence of cracks in the handling with grinder |
|---|---|---|
| 1.5° C./sec < | cracked | cracked |
| 1.5° C./sec ≧ | no crack | cracked |
| 0.3° C./sec < | | |
| 0.3° C./sec ≧ | no crack | no crack |

TABLE 2

| | Chemical Composition (% by weight) | | | | | | | | | | |
|---|---|---|---|---|---|---|---|---|---|---|---|
| No. | C | Si | Mn | P | S | Ni | Cr | Mo | V | sol.Al | O (ppm) |
| Example | | | | | | | | | | | |
| 1 | 0.40 | 2.51 | 0.73 | 0.015 | 0.015 | 1.70 | 0.81 | 0.35 | 0.18 | 0.021 | 11 |
| 2 | 0.41 | 2.49 | 0.71 | 0.017 | 0.010 | 1.71 | 0.81 | 0.35 | 0.18 | 0.028 | 10 |
| 3 | 0.40 | 2.50 | 0.71 | 0.012 | 0.016 | 1.73 | 0.81 | 0.36 | 0.19 | 0.015 | 10 |
| 4 | 0.40 | 2.49 | 0.71 | 0.016 | 0.012 | 1.80 | 0.82 | 0.37 | 0.18 | 0.022 | 9 |
| 5 | 0.41 | 2.49 | 0.73 | 0.010 | 0.009 | 1.75 | 0.75 | 0.35 | 0.20 | 0.025 | 8 |
| 6 | 0.40 | 2.51 | 0.72 | 0.012 | 0.010 | 1.74 | 0.76 | 0.34 | 0.19 | 0.018 | 9 |
| 7 | 0.42 | 2.51 | 0.73 | 0.013 | 0.009 | 1.81 | 0.76 | 0.35 | 0.18 | 0.020 | 8 |
| 8 | 0.41 | 2.50 | 0.71 | 0.015 | 0.011 | 1.77 | 0.77 | 0.36 | 0.19 | 0.025 | 7 |
| 9 | 0.41 | 2.50 | 0.73 | 0.013 | 0.015 | 1.76 | 0.79 | 0.36 | 0.18 | 0.022 | 9 |
| 10 | 0.40 | 2.50 | 0.72 | 0.017 | 0.012 | 1.75 | 0.81 | 0.37 | 0.17 | 0.025 | 9 |
| 11 | 0.41 | 2.50 | 0.71 | 0.014 | 0.016 | 1.85 | 0.80 | 0.36 | 0.18 | 0.026 | 8 |
| 12 | 0.40 | 2.51 | 0.71 | 0.015 | 0.013 | 1.70 | 0.79 | 0.38 | 0.19 | 0.017 | 15 |
| 13 | 0.40 | 2.51 | 0.72 | 0.016 | 0.009 | 1.76 | 0.81 | 0.36 | 0.21 | 0.018 | 14 |
| Comparative Example | | | | | | | | | | | |
| 14 | 0.42 | 2.50 | 0.72 | 0.012 | 0.010 | 1.82 | 0.76 | 0.37 | 0.22 | 0.027 | 18 |
| 15 | 0.40 | 2.51 | 0.71 | 0.015 | 0.011 | 1.78 | 0.78 | 0.35 | 0.19 | 0.022 | 17 |

TABLE 2-continued

| No. | Chemical Composition (% by weight) | | | | | | | | | | |
|---|---|---|---|---|---|---|---|---|---|---|---|
| | C | Si | Mn | P | S | Ni | Cr | Mo | V | sol.Al | O (ppm) |
| 16 | 0.41 | 2.50 | 0.73 | 0.017 | 0.015 | 1.77 | 0.77 | 0.36 | 0.19 | 0.025 | 16 |
| 17 | 0.40 | 2.51 | 0.72 | 0.014 | 0.015 | 1.80 | 0.76 | 0.36 | 0.20 | 0.026 | 17 |

Therefore, it is desirable that the cooling rate of the billet after the blooming is restricted to not more than 1.5° C./sec for preventing the occurrence of cracks in the cooling of the billet. Particularly, it is favorable that the cooling rate of the billet is not more than 0.3° C./sec for preventing the occurrence of cracks in the cooling of the billet and in the handling with the grinder.

Moreover, the adjustment of the cooling rate for the billet is desirable to be conducted by a proper means such as cooling in furnace, cover shielding straw covering or the like.

In the high-strength spring steel according to the invention, the amount of the oxide particle inclusion having a diameter of not less than 10 μm is controlled to not more than 12 particles/100 mm², so that the fatigue fracture due to the oxide particle inclusion hardly occur when the steel is used as a spring and the fatigue limit is improved. That is, the spring steel according to the invention is a spring material having excellent fatigue resistance and high fatigue strength.

The following examples are given in illustration of the invention and are not intended as limitations thereof.

Each of steels having the chemical compositions shown in the above Table 2 was melted by steel-making in an electric furnace, refining in ladle, forced stirring with gas, degassing under vacuum and the like and then shaped in an ingot making mold to obtain an ingot.

Thereafter, the resulting ingot was bloomed at 1300° C. and a reduction ratio of 95% (section in 700 mm square→section in 153 mm square) into a billet and then the resulting billet was cooled at a cooling rate of 0.1° C./sec.

Then, the billet was drawn in a wire rod mill (section in 153 mm square→section in circle of 20 mm) to obtain a spring steel wire.

The number of oxide particle inclusion having a diameter of not less than 10 μm in the each wire per unit area of 100 mm² was measured to obtain results as shown in Table 3.

Thereafter, a test specimen for use in Ono's rotating bending fatigue test was prepared, and subjected to a heat treatment at a quench hardening temperature of 870° C. and a tempering temperature of 340° C., and then a Vicker's hardness (Hv) was measured to obtain results as shown in Table 3.

Further, the above test specimen was subjected to Ono's rotating bending fatigue test to obtain values of fatigue limit as shown in Table 3.

TABLE 3

| No. | Maximum number of oxide particle inclusion having a diameter of not less than 10 μm (particles/100 mm²) | Average number of oxide particle inclusion having a diameter of not less than 10 μm (particles/100 mm²) | Hardness (Hv) | Fatigue limit (N/mm²) |
|---|---|---|---|---|
| Example | | | | |
| 1 | 6 | 5.5 | 588 | 822 |
| 2 | 8 | 7.6 | 580 | 800 |
| 3 | 8 | 7.2 | 583 | 850 |
| 4 | 3 | 2.1 | 578 | 860 |
| 5 | 5 | 4.4 | 578 | 830 |
| 6 | 4 | 3.1 | 580 | 840 |
| 7 | 4 | 3.2 | 584 | 900 |
| 8 | 2 | 1.0 | 580 | 913 |
| 9 | 2 | 1.5 | 586 | 893 |
| 10 | 2 | 1.8 | 588 | 918 |
| 11 | 3 | 2.5 | 578 | 883 |
| 12 | 11 | 10.8 | 582 | 800 |
| 13 | 12 | 11.5 | 584 | 801 |
| Comparative Example | | | | |
| 14 | 17 | 16.3 | 588 | 760 |
| 15 | 16 | 15.2 | 578 | 750 |
| 16 | 14 | 13.4 | 580 | 793 |
| 17 | 15 | 14.3 | 584 | 755 |

As seen from the results of the above tables, in case of Examples 1–13 according to the invention in which the number of oxide particle inclusion having a diameter of not less than 10 μm in steel is not more than 12 particles/100 mm², the value of fatigue limit is not less than 800 N/mm², while in case of Comparative Examples 14–17 in which the number of oxide particle inclusion having a diameter of not less than 10 μm in steel exceeds the upper limit defined in the invention, the fatigue limit is poor as compared with that of the invention.

In the high-strength spring steel according to the invention, the number of oxide particle inclusion having a diameter of not less than 10 μm is restricted to not more than 12 particles/100 mm², so that the higher value of fatigue limit is obtained and consequently the steels according to the invention are very suitable as a material for spring having a high fatigue stength.

What is claimed is:

1. A high-strength spring steel consisting essentially of C: 0.3–0.5%, Si: 1.0–3.0%, Mn: 0.5–1.5%, P: not more than 0.02%, S: 0.01–0.02%, Ni: 0.1–2.0%, Cr: 0.5–1.0%, Mo: 0.1–0.5%, V: 0.1–0.5%, Al: 0.01–0.03% O: not more than 0.002%; wherein the balance is Fe and inevitable impurity, and wherein said oxygen is present in the form of oxide particles and the amount of said oxide particles having a diameter of not less than 10 μm is limited to an average number of oxide particles from 1 to 12 particles/100 $mm^2$.

2. A method of producing high-strength spring steel, comprising the steps of:

melting a steel having a composition consisting essentially of C: 0.3–0.5%, Si: 1.0–3.0%, Mn: 0.5–1.5%, P: not more than 0.02%, S: 0.01–0.02%, Ni: 0.1–2.0%, Cr: 0.5–1.0%, Mo: 0.1–0.5%, V: 0.1–0.5%, Al: 0.01– 0.03% O: not more than 0.002%; and the balance being Fe and inevitable impurity to form a molten steel;

degassing the molten steel to provide a degassed steel;

casting the degassed steel to obtain an ingot or a cast steel slab;

blooming the ingot or the cast steel slab at a temperature of not lower than 1200° C. to form a bloomed steel, and cooling the bloomed steel at an average cooling rate of not more than 0.3° C./sec to provide a cooled steel;

wherein said oxygen in said cooled steel is present in the form of oxide particles, and the amount of said oxide particles having a diameter of not less than 10 μm is controlled to an average number of oxide particles from 1 to 12 particles/100 $mm^2$.

3. A high-strength spring steel according to claim 1, wherein said steel consists essentially of C: 0.4–0.42%, Si: 2.49–2.51%, Mn: 0.71–0.73%, P: not more than 0.017%, S: 0.01–0.016%, Ni: 1.7–1.85%, Cr: 0.75–0.82%, Mo: 0.34–0.38%, V: 0.17–0.21%, Al: 0.015–0.028% O: not more than 0.0015%; wherein the balance is Fe and inevitable impurity.

4. A method of producing high-strength spring steel according to claim 2, wherein said steel having a composition consisting essentially of C: 0.4–0.42%, Si: 2.49–2.51%, Mn: 0.71–0.73%, P: not more than 0.017%, S: 0.01–0.016%, Ni: 1.7–1.85%, Cr: 0.75–0.82%, Mo: 0.34–0.38%, V: 0.17–0.21%, Al: 0.015–0.028% O: not more than 0.0015%; and the balance being Fe and inevitable impurity.

* * * * *